US009573407B2

(12) United States Patent
Marchant et al.

(10) Patent No.: US 9,573,407 B2
(45) Date of Patent: Feb. 21, 2017

(54) SECURITY SUBSTRATES

(75) Inventors: Simon Dexter Marchant, Basingstoke (GB); Paul Howland, Andover (GB); Janina Möreke, Braunschweig (DE)

(73) Assignee: De La Rue International Limited, Hampshire (GB)

( * ) Notice: Subject to any disclaimer, the term of this patent is extended or adjusted under 35 U.S.C. 154(b) by 752 days.

(21) Appl. No.: 13/376,099

(22) PCT Filed: May 24, 2010

(86) PCT No.: PCT/GB2010/001033

§ 371 (c)(1),
(2), (4) Date: Dec. 2, 2011

(87) PCT Pub. No.: WO2010/139930

PCT Pub. Date: Dec. 9, 2010

(65) Prior Publication Data

US 2012/0074684 A1 Mar. 29, 2012

(30) Foreign Application Priority Data

Jun. 4, 2009 (GB) ..... 0909652.0

(51) Int. Cl.
*B42D 25/29* (2014.01)
*B42D 25/00* (2014.01)
*B42D 25/351* (2014.01)

(52) U.S. Cl.
CPC ..... *B42D 25/00* (2014.10); *B42D 25/29* (2014.10); *B42D 25/351* (2014.10); *B42D 2033/06* (2013.01); *B42D 2033/20* (2013.01); *B42D 2035/24* (2013.01)

(58) Field of Classification Search
CPC ..... B42D 25/23; B42D 25/351
USPC ..... 283/85, 91, 113; 428/29
See application file for complete search history.

(56) References Cited

U.S. PATENT DOCUMENTS 4,307,899 A * 12/1981 Hoppe ..... 283/91
4,407,525 A * 10/1983 Hoppe ..... 283/91
5,449,200 A 9/1995 Andric et al.
6,471,248 B2 * 10/2002 Hardwick et al. ..... 283/91
(Continued)

FOREIGN PATENT DOCUMENTS

EP 0657292 A1 6/1995
EP 1592561 8/2004
(Continued)

OTHER PUBLICATIONS

Eu, Peter, et al., World Polymer Banknotes, Article, 2006, ISBN: 983-43038-2-3, Eureka Metro Sdn Bhd.
(Continued)

*Primary Examiner* — Kyle Grabowski
(74) *Attorney, Agent, or Firm* — Gable Gotwals

(57) ABSTRACT

The security substrate includes an at least partially light transmitting carrier supporting a security feature and includes at least first and second layers, at least one of which covers an area which is less than a full surface area of the carrier and which at least partially overlaps the other layer. The layers have substantially the same color and texture, and the reflective contrast ratio of the overlapping areas and the non-over lapping areas is less than 20% and the transmissive contrast ratio of the overlapping areas and the non-overlapping areas is greater than 3%.

24 Claims, 5 Drawing Sheets

(56) References Cited

U.S. PATENT DOCUMENTS

2008/0030020 A1* 2/2008 Mallol et al. ..... 283/91

FOREIGN PATENT DOCUMENTS

| | | | |
|---|---|---|---|
| GB | 2282563 | | 4/1995 |
| WO | 97/47478 | | 12/1997 |
| WO | 0103944 | | 1/2001 |
| WO | 2004106078 | | 12/2004 |
| WO | 2005047013 | A2 | 5/2005 |
| WO | 2010/139930 | A1 | 12/2010 |

OTHER PUBLICATIONS

Van Renesse, Rudolf L.., Optical Document Security, Article, 2005, Artech House, 3rd Ed., ISBN 1-58053-258-6, 89-90.
Van Renesse, Rudolf et al., Optical Security and Counterfeit Deterrence Techniques III, 2000, SPIE—The International Society for Optical Engineering, vol. 3973.
Reserve Bank of Australia, Banknote Features of $5 $10 $20 $50 $100 Banknotes.
The Australian Bicentennial $10 note released by the Reserve Bank of Australia 1988, p. 27 of D3, Figure 3.35 of D4 and in D11.
Wilkin, Trevor "Paper Banknotes, Polymer Banknotes", 2008.
Brunei 1996 Circulation Issue, Negara Brunei Darussalam Note Printing Australia, pp. 47, 48, 49.
Substrate-Based Security, p. 90, Figure 3.36 detail of Romanian 500,000 Lei note.

* cited by examiner

SECURITY SUBSTRATES

CROSS-REFERENCER TO RELATED APPLICATIONS

This application is the United States National Phase of PCT Patent Application No. GB2010/001033filed on May 24, 2010, which claims priority to British Patent Application No. 0909652.0 filed Jun. 4, 2009, both of which are incorporated herein by reference.

BACKGROUND OF THE INVENTION

The present invention relates to improvements in security substrates incorporating a security feature which inhibits the ability of counterfeiters to produce counterfeit notes which is formed from at least two layers which are indistinguishable in reflected light but are distinguishable in transmitted light.

The increasing popularity of colour photocopiers and other imaging systems and the improving technical quality of colour photocopies has led to an increase in the counterfeiting of banknotes, passports, and identification cards etc. There is, therefore, a need to add additional authenticating or security features to existing features. Steps have already been taken to introduce optically variable features which cannot be reproduced by a photocopier into such documentation. There is also a demand to introduce features which are discernible by the general public but which are "invisible" to, or viewed differently, by a photocopier. Since a photocopying process typically involves scattering high-energy light off an original document containing the image to be copied, one solution is to incorporate one or more features into the document which have a different perception in reflected and transmitted light, one example being watermarks and enhancements thereof.

US-B-4,307,899 describes an identification card with hallmarks which are adapted to be inspected in both transmitted and incident light. This comprises a homogenous white layer printed on a transparent substrate with a layer printed thereover which has gaps in the form of indicia. A further layer is printed on top of this layer in the form of the indicia, but offset with regard to the gap. When viewed in transmitted light, the single layer printed portions appear bright, whilst in incident light they appear dark. The multilayer printed portions, on the other hand, appear dark in transmitted light and bright in incident light, thus producing a watermark like effect.

EP-A-0657297 describes a security document which uses light interference pigments in a layer printed over a transparent support, over which is printed a pattern containing a common light reflecting pigment. This provides a security feature which cannot be copied by photographic techniques. By changing the viewing conditions from transmission to reflection mode, the differently printed parts change their colours complementarily, so that the colours become inverted.

Another type of security feature which cannot be reproduced by a photocopier is one which has different perceptions at different viewing angles in reflected light, an example of which is described in EP-A-1592561. In the method described in this patent specification a motif is printed on to a substrate, over the top of which is printed a semi-transparent motif using an optically variable ink. This enables the background on which it is printed to be visible in reflected light, whilst allowing the overlying motif to be seen at varying angles. This represents a combination of three superimposed colours, being the background colour and the two colours of the optically variable ink.

SUMMARY OF THE INVENTION

It is one object of the present invention to provide an improved security substrate incorporating a security feature which is difficult to counterfeit, whilst being relatively easy to incorporate in a security document which has different appearance in reflected and transmitted light.

The invention therefore provides a security substrate comprising an at least partially light transmitting carrier supporting a security feature said security feature comprising at least first and second layers, at least one of said first and second layers covering an area which is less than a full surface area of the carrier and which at least partially overlaps the other layer, wherein the layers have substantially the same colour and texture and the reflective contrast ratio between the overlapping areas and the non-overlapping areas is less than 20% and the transmissive contrast ratio between the overlapping areas and the non-overlapping areas is greater than 3%.

BRIEF DESCRIPTION OF THE DRAWINGS

Preferred embodiments of the present invention will now be described, by way of example only, with reference to the accompanying drawings in which.

DESCRIPTION OF THE INVENTION

Figure 1:
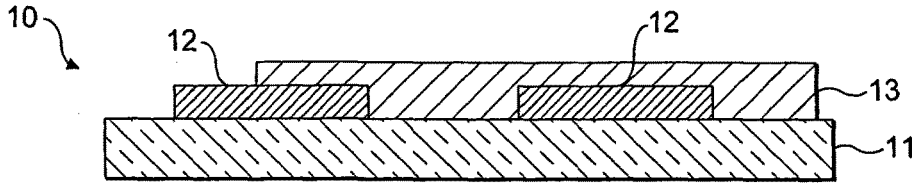
FIG. 1 is a cross-sectional side elevation of a security substrate according to the present invention.

Referring to FIG. 1, the security substrate 10 of the present invention comprises a carrier 11 bearing a security feature comprising two separate layers. The carrier 11 is pellucid and therefore at least partly light transmitting, i.e. transparent or translucent. The definition of translucent in this context is permitting light to pass through but diffusing it so that persons, objects etc. on the opposite side can be perceived but are not clearly visible, e.g. frosted window glass is translucent but not transparent. The carrier 11 is preferably made of an impermeable polymeric film. Suitable polymeric films are, for example, those made from polyethylene terephthalate (PET) which are commercially available from Dupont under the trade name Melinex and polypropylene which are commercially available from ExxonMobil.

Figure 2:
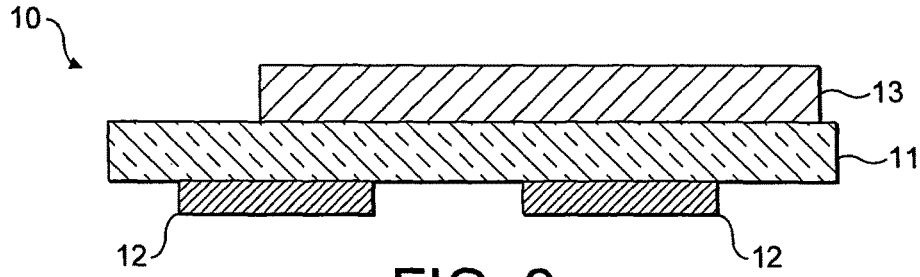
FIG. 2 is a cross-sectional side elevation of another embodiment of a security substrate of the present invention.

The security feature comprises a first layer 12, which either fully covers one surface of the carrier 11, or a smaller region of the surface of the layer carrier 11, or a plurality of smaller regions. A second layer 13 is applied so that it wholly or partially overlaps the first layer 12. Again, the second layer 13 may be a full layer, or a partial layer covering a smaller region or a plurality of smaller regions. At least one of the layers 12, 13 must cover an area less than the entire surface of the carrier 11 and is preferably in the form of at least one image or indicia. In the embodiment shown in FIG. 1, the layers 12, 13 are applied directly one over the other on the same side of the carrier 11. Alternatively, as shown in FIG. 2, the layers 12, 13 can be applied on opposite sides of the carrier 11 to each other.

Figure 3A:
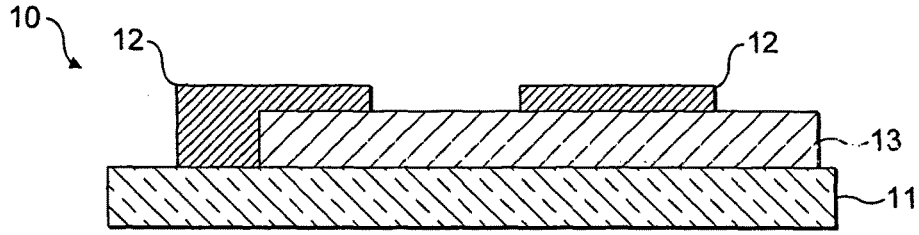
FIG. 3*a* is a cross-sectional side elevation of yet another embodiment of a security substrate of the present invention.
Figure 3B:
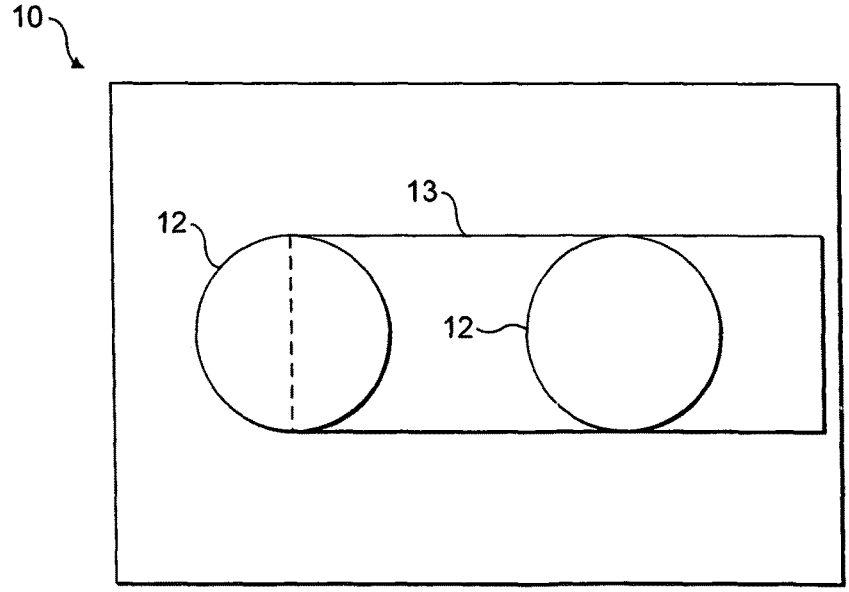
FIG. 3*b* is a plan view of the security substrate of FIG. 3*a*.

As a further alternative, the second layer 13 may be applied to the carrier 11 first, with the first layer 12 at least partially overlapping it, as shown in FIG. 3. In a further embodiment, one of the layers 12, 13 lies wholly within the boundaries of the other of said layers 12, 13 and may be applied above or below it.

Figure 4:
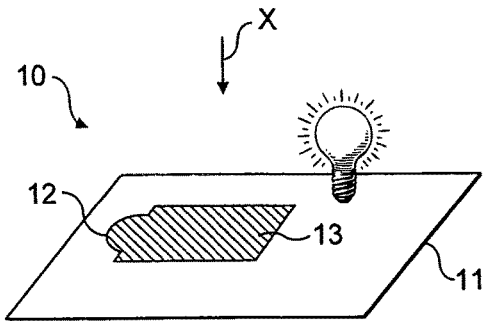
FIG. 4 is a pictorial representation of the substrate of FIGS. 3*a* and 3*b* viewed in reflected light.
Figure 5:
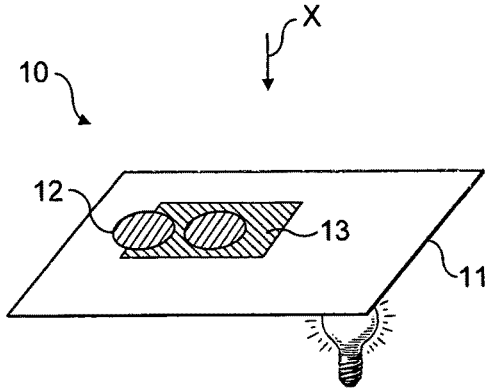
FIG. 5 is a pictorial representation of the substrate of FIGS. 3*a* and 3*b* viewed in transmitted light.

The properties of the first and second layers 12, 13 are such that, when viewed in reflected light, the first and second layers 12, 13 are substantially indiscernible with the appearance of only a single homogenous area covering the total area covered by both layers 12, 13 being visible. When the substrate 10 is viewed in transmitted light, however, layers 12, 13 are clearly distinguishable from each other and any images formed by one or both layers 12, 13 are clearly visible. This surprising effect is shown figuratively in FIGS. 4 and 5 which show, respectively, the effect in reflected and transmitted light of the embodiment of the security substrate 10 shown in FIG. 3*a*. When the substrate 10 is viewed in reflected light from the direction of arrow X there is essentially no visible difference in the appearance between regions 12, 13 whether they are overlapping or not; only a single homogenous area will be seen. When viewed from the direction of arrow X in transmitted light (FIG. 5) the two circular shaped areas of first layer 12 will be distinguishable from the rectangular shaped area of the second layer 13.

The first and second layers 12, 13 are preferably printed. It should be noted that the inks used in layers 12, 13 do not necessarily have to be the same ink, although it is preferred that they are the same.

In the printed embodiment of the invention, the preferred inks for use in the first and second layers 12, 13 are optically variable inks (OVIs), inks comprising mixtures of optically variable pigments and coloured pigments, metallic inks, reflective inks which satisfy the criteria set out above. The inks may be printed using any suitable method, such as screen printing, gravure and so on.

Optically variable pigments having a colour shift between two distinct colours, with the colour shift being dependent on the viewing angle, are well known. The production of these pigments, their use and their characteristic features are described in, inter-alia, U.S. Pat. Nos. B-4,434,010, B-5,059,245, B-5,084,351, B-5,135,812, B-5,171,363, B-5,571,624, EP-A-0341002, EP-A-0736073, EP-A-668329, EP-A-0741170 and EP-A-1114102. Optically variable pigments having a viewing angle dependent shift of colour are based on a stack of superposed thin-film layers with different optical characteristics. The hue, the amount of colour-shifting and the chromaticity of such thin-film structures depend inter alia on the material constituting the layers, the sequence and the number of layers, the layer thickness, as well as on the production process. Generally, optically variable pigments comprise an opaque totally reflecting layer, a dielectric layer of a low refractive index material (i.e. with an index of refraction of 1.65 or less) deposited on top of the opaque layer and a semi-transparent partially reflecting layer applied on the dielectric layer.

To achieve this surprising effect the optical transmissive and reflective properties of the first and second layers 12, 13 are carefully selected. More specifically there must be a low contrast ratio in reflected light and a high contrast ratio in transmitted light between the region where the first and second layers are superimposed and the region where there is only a single layer. The reflective contrast ratio must be less than 20% and preferably less than 10%. The transmissive contrast ratio must be greater than 3% and preferably greater than 5%. The layers 12, 13 must also have substantially the same colour and reflectivity at any particular angle of viewing in reflected light, and they preferably also have substantially the same texture.

A suitable method for measuring the contrast ratio of the layers 12, 13 is based on the measurement of Luminosity (L) using an Epson Perfection 2540 Photo scanner. The scanner is used to produce digital images that are seen in a manner equivalent to that of the eye. Scans of the feature are carried out in both reflective and transmissive modes. The luminosity of the images from both layer 12 and the combined layers 12 and 13 in the two scanning modes are then measured using software such as Adobe Photoshop supplied by Adobe Systems Inc. The value of luminosity has a scale of 0 (Black) to 256 (White).

The values of luminosity obtained in the reflective mode can be used to obtain a measure of reflectivity and those obtained in transmissive mode to obtain a measure of transmittance. The following data is recorded:

Ltb=transmission luminosity of layer 13

Ltd=transmission luminosity over superimposed layer 12 and 13

Lrb=reflection luminosity of layer 13

Lrd=reflection luminosity over superimposed layers 12 and 13

The transmissivity and reflectivity is then calculated using the following formulae.

Transmissivity of the background layer 13: —

$$Tb=(256-Ltb)/256$$

Transmissivity of superimposed layers 12 and 13: —

$$Td=(256-Ltd)/256$$

Reflectivity of the background layer 13: —

$$Rb=Lrb/256$$

Reflectivity of superimposed layers 12 and 13: —

$$Rd=Lrd/256$$

The contrast ratio, which is a measure of the perceived difference between the background (non-superimposed layers either 12 or 13) and the image area (superimposed layers 12 and 13) in the two viewing modes, can then be calculated as follows:

Reflection contrast ratio (the modulus value is used): —

$$Cr=(Rb-Rd)/(Rb+Rb)*2$$

Transmission contrast ratio: —

$$Ct=(Tb-Td)/(Tb+Tb)*2$$

It is extremely difficult to obtain an exact correlation between the observer assessment and the measured contrast values because the observer is affected by variable ambient conditions and by print and design elements. However experimental work has shown that the feature does not work adequately if one of the following criteria are not met:

1) in transmission the image cannot be seen (Transmission contrast ratio too low);

2) in reflection the image is not substantially hidden (Reflection contrast ratio too high).

It has been found that the limit of the transmission contrast ratio below which the image cannot be seen is 3-5%. The upper limit of the reflectance contrast ratio above which the image is not hidden in reflection is 8-20%.

Figure 6:
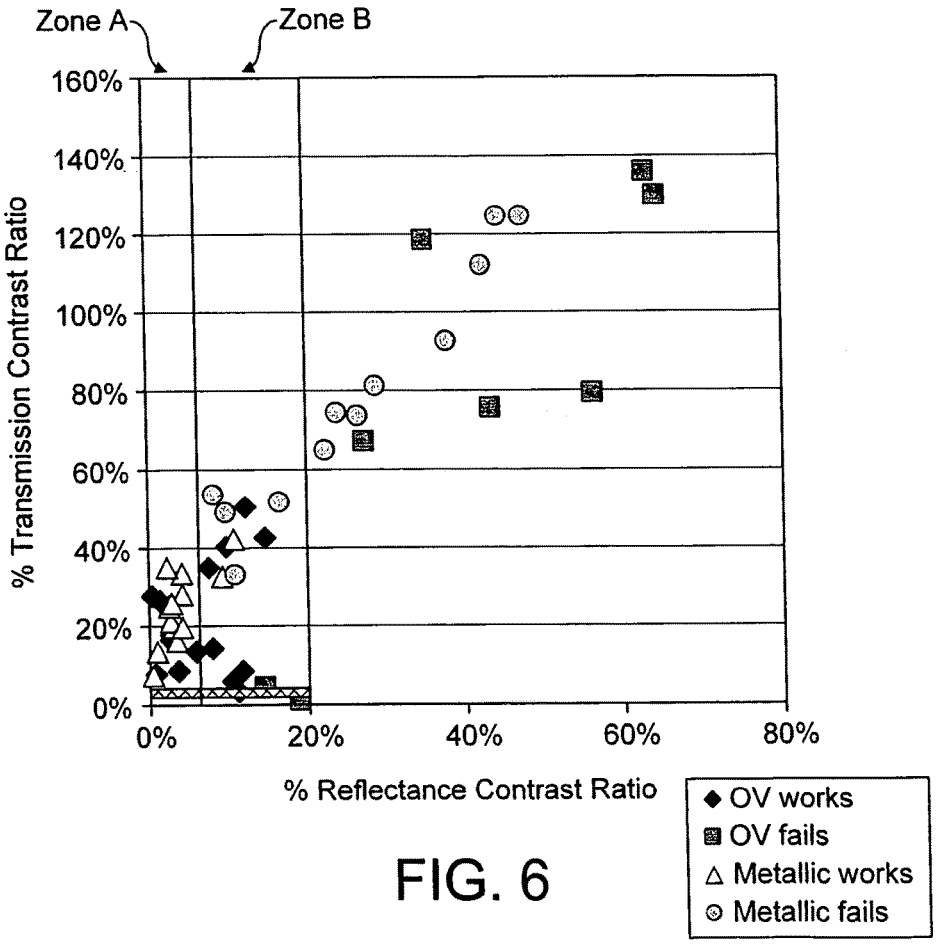
FIG. 6 is a graph showing the results of an analysis of contrast ratios for a particular ink.

FIG. 6 shows a set of results taken from two sets of samples using the aforementioned method. One set of samples has been produced using an optically variable (OV) pigment and a set of samples have been produced using a metallic pigment. The combination of transmission contrast ratio and reflection contrast ratios which provide the required different views in reflection and transmitted light are those limited to the left hand zone A. The combinations in Zone B are those which may work, depending on design and viewing conditions.

An example of a suitable working formulation of a screen ink comprising an OV pigment is:

Sicpa OVI Pigment—20 weight %

Sicpa Dual Cure Silkscreen Varnish 9Z3D50—80 weight %

An example of a suitable working formulation of a screen ink comprising a metallic pigment is:

Aluminium Powder(Debdale Metal Powders Ltd)) (particle size 19×7×2 μm)—5 weight %

Seristar SX solvent based Varnish—95 weight %

The security substrate of the present invention can be used in a variety of ways, for example partially embedded into a paper or plastic substrate from which a security document can be formed or applied to the surface of a substrate. Alternatively the security substrate itself may be formed directly into one of the following examples which include:

a) elongate security elements and tapes. There are many examples of these known in the prior art, including those described in EP-A-0059056, EP-A-086029, EP-A-1141480 and WO-A-03054297;

b) polymer security substrates (e.g. banknotes), especially those comprising an uncoated windowed region;

c) foils applied as strips or patches or the like to paper or polymer substrates or document;

d) images printed directly onto paper substrates or documents.

In one embodiment the security substrate 10 to be formed into a security element is subsequently incorporated into a paper or polymer substrate so that it is viewable from both sides of the finished substrate. Methods of incorporating security elements in such a manner are described in EP-A-1141480 and WO-A-03054297. In the method described in EP-A-1141480, one side of the security element is wholly exposed at one surface of the substrate in which it is partially embedded, and partially exposed in windows at the other surface of the substrate.

Substrates suitable for making security documents may be formed from any conventional materials, including paper and polymer. Techniques are known in the art for forming substantially transparent regions in each of these types of substrate. For example, WO-A-8300659 describes a polymer banknote formed from a transparent substrate comprising an opacifying coating on both sides of the substrate. The opacifying coating is omitted in localised regions on both sides of the substrate to form a transparent region. WO-A-0039391 describes a method of making a transparent region in a paper substrate. Other methods for forming transparent regions in paper substrates are described in EP-A-723501, EP-A-724519, WO-A-03054297 and EP-A-1398174.

Figure 7:
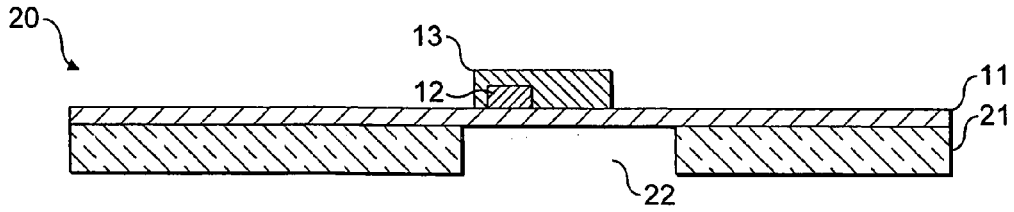
FIGS. 7 to 10 are cross-sectional side elevations of further embodiments of a security substrate of the present invention.

FIG. 7 illustrates an embodiment of the present invention in which the security substrate 10 is in the form of an elongate thread or tape (security device) 20 which has been applied to one side of a paper substrate 21 so that the layers 12, 13 are located in an aperture 22 formed in the paper substrate 21. An example of a method of producing such an aperture 22 can be found in WO-A-03054297. An alternative method of incorporating a security element which is visible in apertures in one side of a paper substrate and wholly exposed on the other side of the paper substrate can be found in WO-A-2000/39391.

Figure 8:
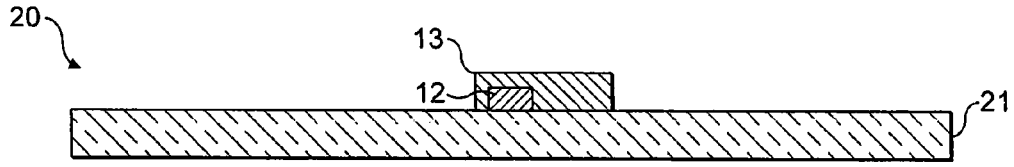
Figure 9:
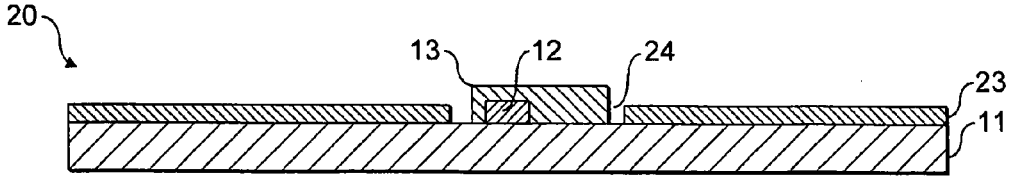

In a further embodiment of the invention illustrated in FIG. 8, the first and second layers 12, 13 are applied directly to a translucent paper substrate 21 (which forms the carrier), used to form a banknote or other type of security document. As a further alternative, illustrated in FIG. 9, the layers 12, 13 are applied to a transparent or translucent carrier 11, such as a polymer banknote which has an opaque coating 23 applied over at least one surface thereof, leaving a clear window 24. The layers 12, 13 are applied in the window 24. As a further alternative the layers 12, 13 are applied to a transparent or translucent area in an otherwise opaque substrate. Such areas may be created either by highlight watermarks or by impregnation of the substrate with a transparentising medium.

It should be noted that if the security substrate is incorporated into a further paper or polymer substrate then the layers 12 and 13 can either be applied to the security substrate before or after it has been incorporated into the further paper or polymer substrate. Alternatively one of the layers 12 or 13 can be applied before and one of the layers can be applied after it has been incorporated into the further paper or polymer substrate.

It will be further understood by those skilled in the art that the substrate of the present invention may be used in combination with existing approaches for the manufacture of security elements. Examples of suitable constructions that can be used include, but are not limited to, those described in WO-A-03061980, EP-A-0516790, WO-A-9825236, and WO-A-9928852.

Figure 10:
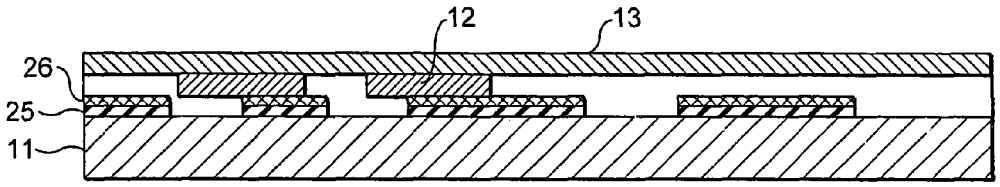
Figure 11A:
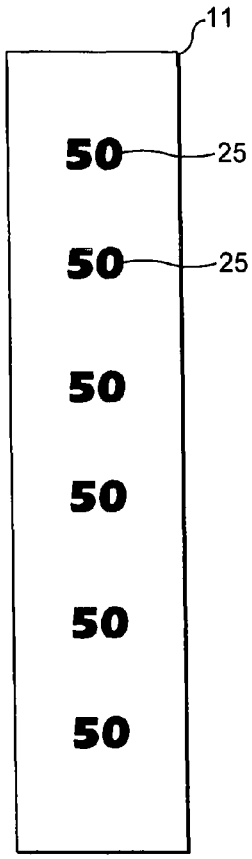
FIGS. 11*a* and 11*b* are plan views of intermediate steps in forming a security substrate for use in the secure document illustrated in FIGS. 12*a* and 12*b*.

In one example the security substrate 10 of the present invention further includes an opaque layer, such as a demetallised metal layer, and this is illustrated in FIG. 10. FIG. 10 shows a cross-sectional view of the security substrate 10, which can be formed into a security element, such as a thread or tape, which is suitable for incorporation in a substrate, such as paper or plastic from which a security document is to be made, in the manner described in EP-A-1141480. The carrier 11 is a substantially transparent or translucent polymeric carrier film. One or more opaque (preferably metallic) regions 25 are formed on the carrier 11, illustrated in FIG. 11*a* in the form of the numeral "50". It is well known how to produce partially metallised/demetallised films in which no metal is present in controlled and clearly defined areas. One way is to selectively demetallise regions using a resist and etch technique such as is described in U.S. Pat. No. 4,652,015. In this case a resist layer 26 is used as shown in FIG. 10. Other techniques are known for achieving similar effects; for example aluminium can be vacuum deposited through a mask, or aluminium can be selectively removed from a composite strip of a plastic carrier and aluminium using an excimer laser. The metallic regions 25 may be provided by printing the carrier 11 with a metal effect ink having a metallic appearance such as Metalstar® inks sold by Eckart.

Figure 11B:
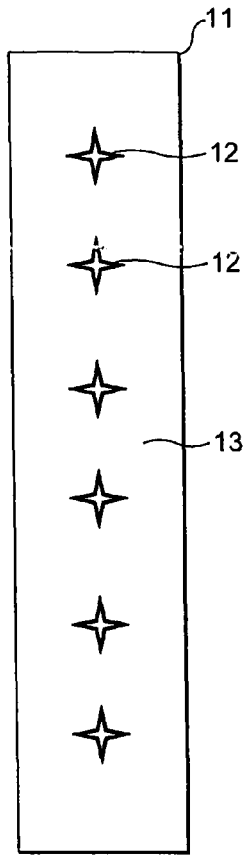
Figure 12A:
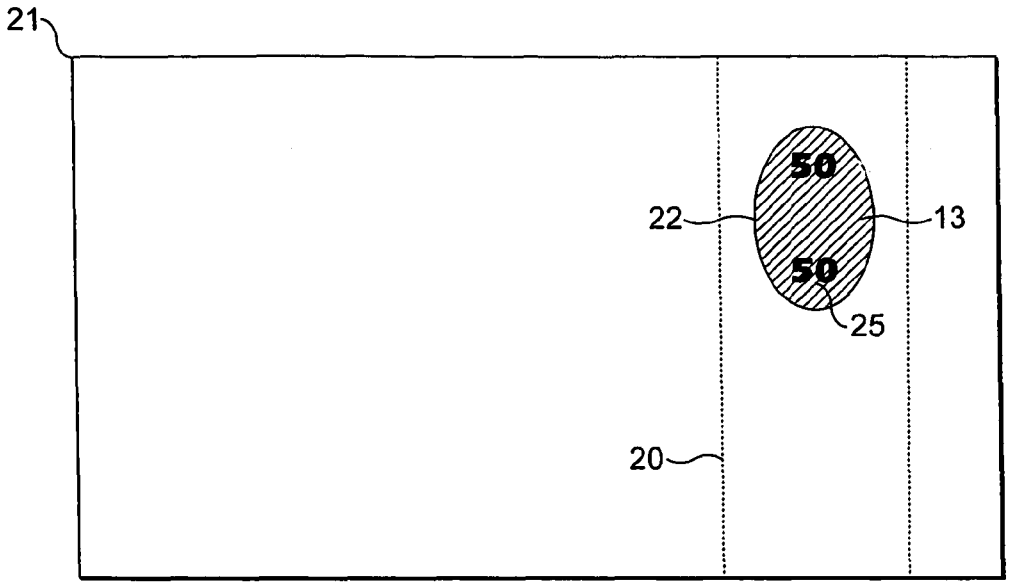
FIGS. 12*a* and 12*b* are plan views of a security document incorporating the security substrate of FIGS. 11*a*, 11*b* when viewed in reflected and transmitted light respectively.
Figure 12B:
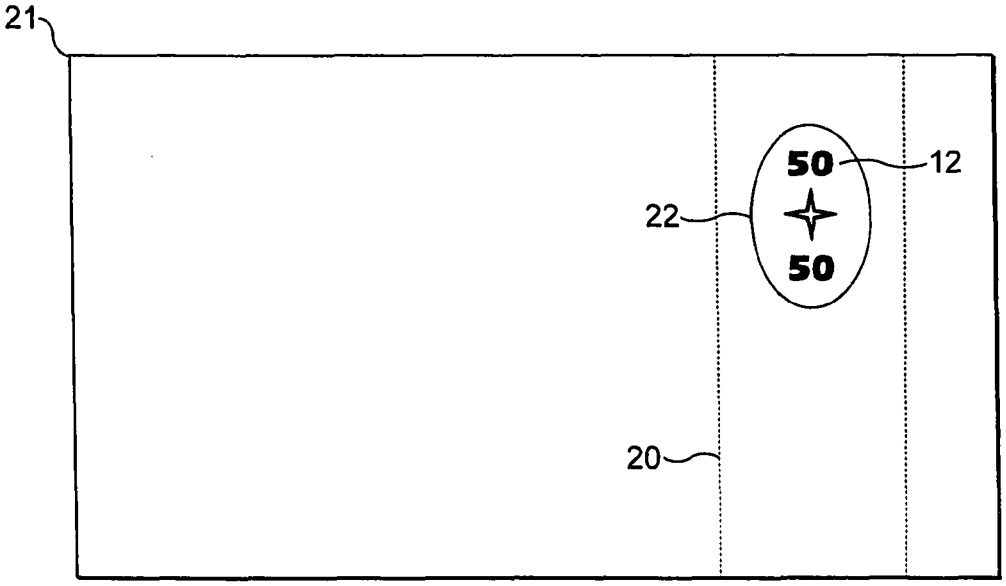

The first and second layers 12,13 are then applied according to the previous embodiments such that in reflected light the first and second layers 12,13 are substantially indiscernible and in transmitted light they are clearly distinguishable. In this example first layer 12 is applied as a repeating array of stars (FIG. 11*b*) and the second layer 13 is applied as an all-over coating covering the whole surface of the polymeric carrier 11, the metallic regions 25 and first printed region 12. An elongate security device 20 formed from the security substrate 10 is preferably incorporated into a substrate 21, such as paper or plastic, from which a security document is to be made using the method described in EP-A-1141480. When viewed in reflection, first layer 13 is fully exposed on the front of the substrate 21 and the metallic regions 25 are exposed in a transparent aperture 22 on the back of the substrate 21 against a background of the second layer 13. FIG. 12*a* illustrates the view from the back of the substrate. If the first and second layers 12 and 13 are produced using the same optically variable ink, then when the front of the substrate 21 is viewed an all-over optically variable coating is observed which changes colour on angle of view for example switching from red to green as the substrate 21 is tilted away from normal incidence. When the back of the substrate 21 is viewed in reflected light, as shown in FIG. 12*a*, in the aperture area metallic regions 25 are observed against an optically variable uniform background. If the substrate is viewed in transmitted light (FIG. 12*b*), silhouettes of both the metallic regions 25 and the second layer 13 are observed. This provides an additional security characteristic to the previous embodiments in that when viewed from the metallic side one image is seen in reflection, whereas two images are seen in transmission.

The opaque regions 25 can be applied in register with layers 12 and 13 and the two resultant images in transmission can be related by their content and design and also may be registered such that a composite image is generated in transmitted light from a combination of the opaque regions 25 and second layer 13. As stated previously, it is not necessary that second layer 13 is an all-over coating and can itself form a printed design. In an alternative construction one or both of the layers 12 and 13 can be applied to the opposite side of the polymeric carrier 11 to the metallic regions 25.

In yet another embodiment, the metallic regions 25 in the embodiment in FIGS. 10-12 may be replaced with any substantially opaque printed indicia.

The security feature of the present invention may also be combined with additional printed regions, which may be coloured, metallic or fluorescent.

The security feature may also be combined with a machine readable feature, such as a magnetic ink, and in particular a transparent magnetic ink such as those described in GB-A-2387812 and GB-A-2387813. Alternatively a machine readable aspect may be provided by the introduction of separate machine-readable layers. In addition to magnetic materials detectable materials that react to an external stimulus include but are not limited to fluorescent, phosphorescent, infrared absorbing, thermochromic, photochromic, electrochromic, conductive and piezochromic materials.

A suitable pigment for use in printed layers 12 and 13 is a magnetic OVI pigment and this provides a further opportunity for enhancing the security feature. The use of a magnetic OVI pigment enables the creation of a further optical effect which makes use of oriented magnetic pigments to generate dynamic and three dimensional-like images. Examples of the prior art describing such features include EP-A-1674282, U.S. Pat. Nos. 6,759,097, A-20040051297, A-20050106367, WO-A-2004007095, WO-A-2006069218, EP-A-1745940, and EP-A-1710756. Typically the magnetic pigments are aligned with a magnetic field after applying the pigment to a surface. Magnetic flakes dispersed in a liquid organic medium orient themselves parallel to the magnetic field lines, tilting from the original planar orientation. This tilt varies from perpendicular to the surface of a substrate to the original orientation, which includes flakes essentially parallel to the surface of the product. The planar oriented flakes reflect incident light back to the viewer, while the re-oriented flakes do not, providing the appearance of a three dimensional pattern in the coating.

WO-A-2004007095 describes the creation of a dynamic optically variable effect known as the "rolling-bar" feature. The "rolling-bar" feature provides the optical illusion of movement to images comprised of magnetically aligned pigment flakes. The flakes are aligned in an arching pattern relative to a surface of the substrate so as to create a contrasting bar across the image appearing between a first adjacent field and a second adjacent field, the contrasting bar appearing to move as the image is tilted relative to a viewing angle. The use of such kinematical images is developed further in EP-A-1674282 wherein the flakes are aligned in either a first or second arching pattern creating first and second contrasting bars which appear to move in different directions simultaneously as the image is tilted relative to a viewing angle. EP-A-1674282 also describes the creation of other rolling objects such as rolling hemispheres.

The security feature comprises at least two layers 12 and 13 but is not limited to two. It may also comprise three or more at least partially overlapping layers and to make a feature comprising more than two overlapping layers with several different materials/inks.

In another embodiment of the invention the layers 12, 13 may comprise a pigment dispersed throughout a transparent or translucent polymer film.

Whilst it is preferred that the layers 12 and 13 are printed using liquid or paste inks by processes such as gravure, lithography, screen, flexo or intaglio, they may also be formed by hot stamping or laminating or coating or some other method.

Following the incorporation of the substrate in the main substrate, the latter (which is used to form a document, such as a banknote), undergoes further standard security printing processes including one or more of the following; wet or dry lithographic printing, intaglio printing, letterpress printing, flexographic printing, screen-printing, and/or gravure printing. In a preferred example and to increase the effectiveness of the security substrate against counterfeiting the design of the security substrate should be linked to the document it is protecting by content and registration to the designs and identifying information provided on the document.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is limited only by the scope of the attached claims, including the full range of equivalency to which each element thereof is entitled.

The invention claimed is:

1. A security substrate, said substrate comprising:

an at least partially light transmitting carrier supporting a security feature, said security feature comprising a first and a second layer and a metallic and a demetallised region at least partially superimposed with the first and second layers, at least one of said first and second layers covering an area which is less than a full surface area of the carrier and which at least partially overlaps the other layer, wherein the first and second layers have substantially the same colour and texture, and the reflective contrast ratio (expressed as a percentage) of the overlapping areas and the non-overlapping areas is less than 20% and the transmissive contrast ratio (expressed as a percentage) of the overlapping areas and the non-overlapping areas is greater than 3%, the contrast ratios of each of the areas defined by the first and second layers being selected in combination with one another such that;

when the security substrate is viewed in reflected light, the first and second layers are indiscernible from each other and have the appearance of a single homogenous area; and when the substrate is viewed in transmitted light, the first and second layers are clearly distinguishable from each other.

2. A security substrate as claimed in claim 1 in which the carrier is transparent.

3. A security substrate as claimed in claim 1 in which at least one of the layers is in the form of an image or indicia.

4. A security substrate as claimed in claim 1 in which at least one of the layers covers one surface of the carrier.

5. A security substrate as claimed in claim 1 in which each of said layers is in the form of an image or indicia.

6. A security substrate as claimed in claim 1 in which the layers are applied to the same surface of the carrier, one at least partially overlying the other.

7. A security substrate as claimed in claim 1 in which the layers are applied to opposing surfaces of the carrier.

8. A security substrate as claimed in claim 1 in which one of said layers lies wholly within the boundaries of the other of said layers.

9. A security substrate as claimed in claim 1 in which the layers are printed.

10. A security substrate as claimed in claim 9 in which the layers are printed with the same ink.

11. A security substrate as claimed in claim 9 in which the layers are printed with different inks.

12. A security substrate as claimed in claim 9 in which the layers are printed with optically variable inks or inks comprising an optically variable pigment or a magnetic optically variable pigment.

13. A security substrate as claimed in claim 12 in which the layers are printed with a mixture of optically variable pigments and coloured pigments.

14. A security substrate as claimed in claim 9 in which the layers are printed with metallic inks.

15. A security substrate as claimed in claim 9 in which the layers are printed with reflective inks.

16. A security substrate as claimed in claim 1 in which at least one of the layers comprise a pigment dispersed throughout a light transmitting film, which is applied to the carrier.

17. A security substrate as claimed in claim 1 in which the reflective contrast ratio (expressed as a percentage) is less than 10%.

18. A security substrate as claimed in claim 1 in which the transmissive contrast ratio (expressed as a percentage) is greater than 5%.

19. A security substrate as claimed in claim 1 in which the carrier is a paper substrate.

20. A security substrate as claimed in claim 1 in which the carrier is a plastic substrate.

21. A security article incorporating a security substrate as claimed in claim 1.

22. A security article as claimed in claim 21 in which the security substrate is applied to a surface of the security article in the form of a patch, foil, stripe or the like.

23. A security article as claimed in claim 21 in which the security substrate is at least partially embedded in the security article and exposed in at least one window therein.

24. A security article as claimed in claim 21 comprising a banknote, passport, certificate or other document of value.

* * * * *